United States Patent [19]

Lim et al.

[11] Patent Number: 4,911,556

[45] Date of Patent: Mar. 27, 1990

[54] TURBULENT STIRRING UNIT

[75] Inventors: Franklin Lim; William H. Bingham, both of Richmond; Richard D. Moss, Chester, all of Va.

[73] Assignee: Lim Technology Laboratories, Inc., Richmond, Va.

[21] Appl. No.: 324,676

[22] Filed: Mar. 17, 1989

[51] Int. Cl.[4] ..... B01F 13/08

[52] U.S. Cl. ..... 366/279

[58] Field of Search ..... 366/273, 274, 127; 310/26, 27, 40 R, 46

[56] References Cited

U.S. PATENT DOCUMENTS

| | | | |
|---|---|---|---|
| 2,655,354 | 10/1953 | Murray . | |
| 2,837,320 | 6/1958 | Baron . | |
| 3,088,716 | 5/1963 | Stott . | |
| 3,138,370 | 6/1964 | Anderson et al. . | |
| 3,168,294 | 2/1965 | Hasumura . | |
| 3,245,665 | 4/1966 | Steel . | |
| 3,384,353 | 5/1968 | Worth . | |
| 3,399,869 | 9/1968 | Loria et al. . | |
| 3,538,341 | 11/1970 | Pankow . | |
| 3,554,497 | 1/1971 | Zipperer . | |
| 3,601,372 | 8/1971 | Harmes . | |
| 3,645,508 | 2/1972 | Balteau . | |
| 3,680,843 | 8/1972 | Lu et al. . | |
| 3,693,941 | 9/1972 | Suchy | 366/274 |
| 4,080,663 | 3/1978 | Wik . | |
| 4,131,370 | 12/1978 | Lawrence et al. . | |
| 4,162,855 | 7/1979 | Bender . | |
| 4,355,906 | 10/1982 | Ono . | |
| 4,390,283 | 6/1983 | Meyer . | |
| 4,477,192 | 10/1984 | Bonney . | |
| 4,534,656 | 8/1985 | de Bruyne . | |
| 4,568,195 | 2/1986 | Herz et al. . | |
| 4,728,500 | 3/1988 | Higo . | |
| 4,752,138 | 6/1988 | Rufer . | |

FOREIGN PATENT DOCUMENTS

| | | | |
|---|---|---|---|
| 1026902 | 2/1953 | France | 366/274 |

*Primary Examiner*—Robert W. Jenkins

*Attorney, Agent, or Firm*—Burns, Doane, Swecker & Mathis

[57] ABSTRACT

Efficient mixing is promoted in a turbulent stirring unit by providing an agitator with flexible finger-like appendages and by varying the rate of rotation of a rotating magnetic field such that the fingers execute an undulatory motion, disrupting laminar flow and tending to collapse the liquid vortex. Motor control for controlling the fluctuation of the rotating magnetic field may provided by simple and economical electronic or electromechanical means. The control unit may be separately configured to control a number of other pieces of equipment, either in common or independently. The controller also may be integrated into stirrers, vortexers or shaker tables or externally provided to control existing units.

17 Claims, 9 Drawing Sheets

FLING-IN

FLING-OUT

SINGLE CONTROLLER - MULTIPLE DEVICES

MULTIPLE CONTROLLERS - MULTIPLE DEVICES

TURBULENT STIRRING UNIT

BACKGROUND OF THE INVENTION

The present invention relates generally to stirring methods and apparatus and more particularly to turbulent stirring units which achieve highly efficient mixing.

Magnetic stirring plates for stirring of fluid in a vessel are known in the prior art where a stirring element in the form of a permanent bar magnet is placed in the fluid and rotated by means of an externally applied rotating magnetic field. According to such a method, the stirring element may be rotated without direct physical contact by means of an external rotating magnet.

In the past, magnetic stirrers have been designed and constructed so that the stirring motion produces a vortex whose center is coincident with the axis of rotation. While generally satisfactory, such stirrers have several disadvantages. Once the vortex is established, mixing is quit limited unless the speed is sufficient to cause vortex turbulence. Such turbulence is usually undesirable. This reduction in mixing once the vortex is formed is contrary to the desired goal of an efficient mixing which would achieve rapid and uniform distribution throughout the volume of the fluid.

Other types of "contactless" stirring devices in which this disadvantage is overcome are known. An example of such a prior art device used to achieve a more efficient mixing is the vortex stirrer used in serology. Such a device consists essentially of a surface rotating at constant speed with which a test tube or such held lightly in an operator's hand may be brought into contact, thus rotating the test tube. When a vortex is created, the operator removes the test tube slightly from the rotating surface, causing the vortex to collapse. By repeatedly creating and collapsing the vortex, a fairly efficient mixing is rapidly achieved. Such an operation, however, requires human intervention, is limited to small volumes and is fairly tedious. By application of the principles of the present turbulent stirring unit, operation of the vortex stirrer may be completely mechanized while retaining its high mixing efficiency.

An object of the present invention, therefore, is to provide a stirring method and apparatus for improving the rapidity and effectiveness of mixing.

A further object of the present invention is to provide such an apparatus that operates automatically without human intervention.

Another object of the present invention is to provide such a method according to which numerous processes may be either independently or identically controlled.

SUMMARY OF THE INVENTION

According to an embodiment of the present invention, the magnetic field of a magnetic stirring unit, produced by an external rotating magnet, rotates at a fluctuating rate and the stirring element is provided with a number of finger-like appendages which are either flung outwardly with respect to the axis of rotation or flung inwardly with respect to that axis. A fluctuating rate serves both to collapse the vortex, thereby increasing mixing, and to undulate the finger appendages, which further improves mixing.

According to another embodiment of the present invention, instead of using a stirring element, the entire vessel containing a fluid composition to be mixed is placed on a plate which may be rotated or vibrated at the fluctuating rate, causing vortexes to alternately form and collapse. Fluctuating rates of rotation are controlled by a controller through which the stirring is powered. A single control unit may be used to identically control a number of stirring processes up to the current limit of the controller. Alternatively, a number of control units may be provided to independently coordinate and control a number of related stirring processes.

BRIEF DESCRIPTION OF THE DRAWINGS

FIG. 1(*b*) is a perspective view of a turbulent stirring unit with its associated control unit according to another embodiment of the present invention;

FIG. 5(*b*) is a schematic diagram showing one possible implementation of the control unit of FIG. 5(*a*);

DETAILED DESCRIPTION OF THE PREFERRED EMBODIMENTS

Figure 1A:
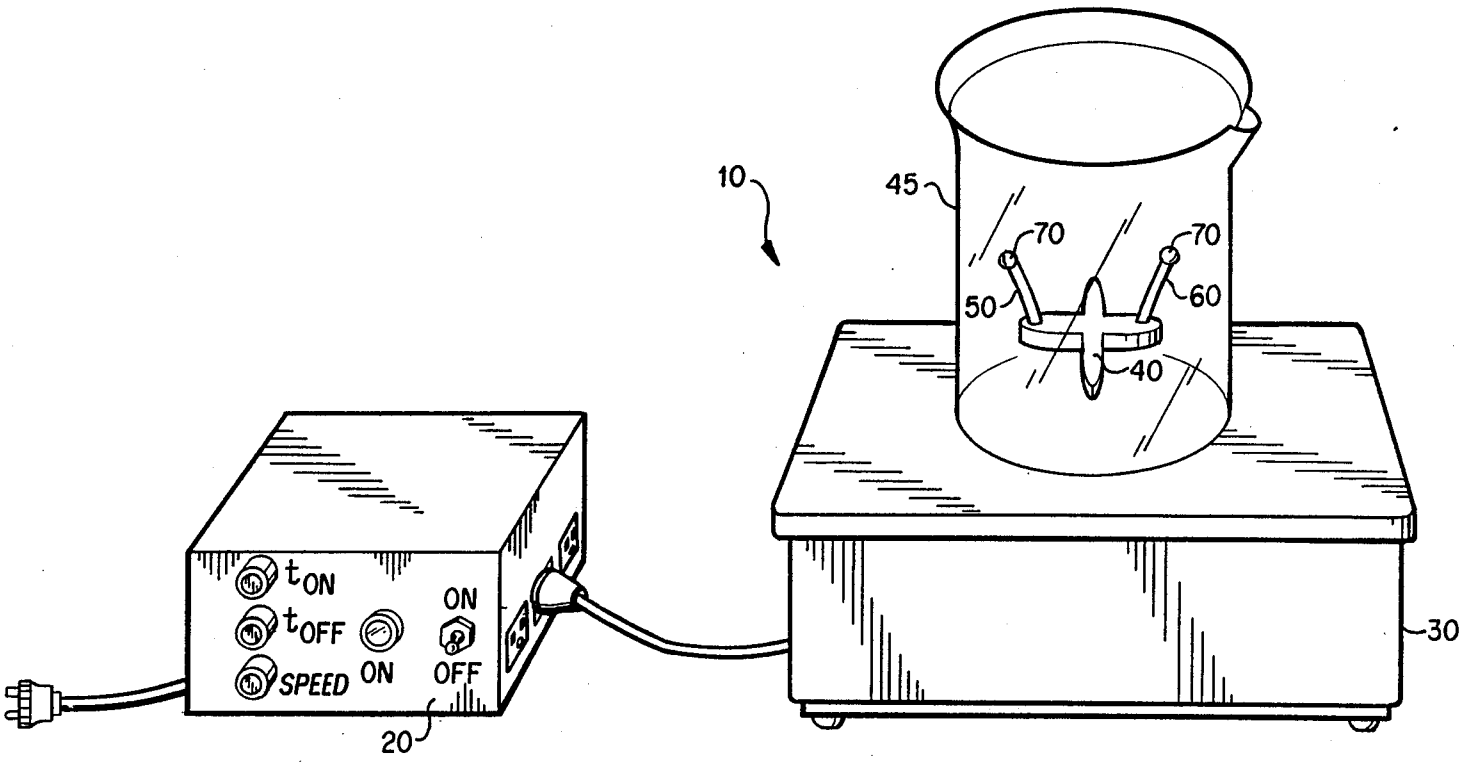
FIG. 1(*a*) is a perspective view of a turbulent stirring unit with its associated control unit according to one embodiment of the present invention.
Figure 1B:
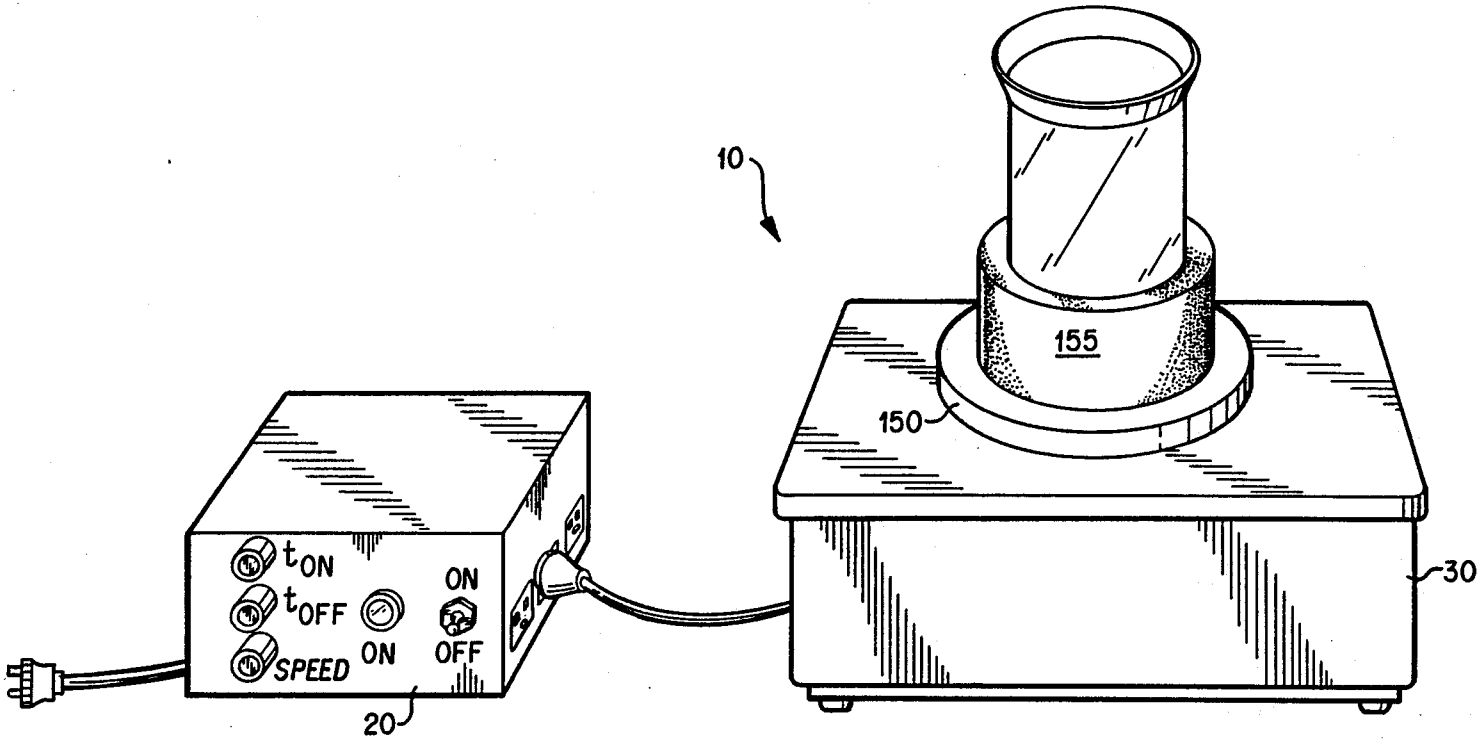
Figure 2:
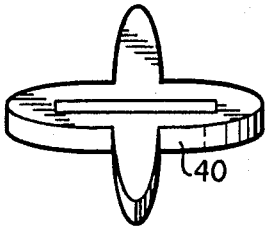
FIG. 2 is a perspective view of the underside of a stirring element forming part of an embodiment of the present invention.
Figure 3A:
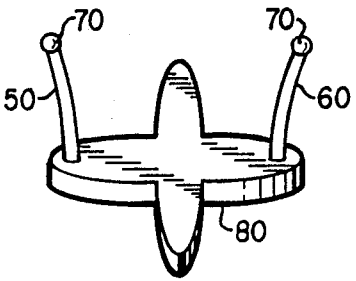
FIG. 3(*a*) is a plan view of a "fling-out" type of stirring element and FIG. 3(*b*) is a schematic representation of its operation.
Figure 3B:
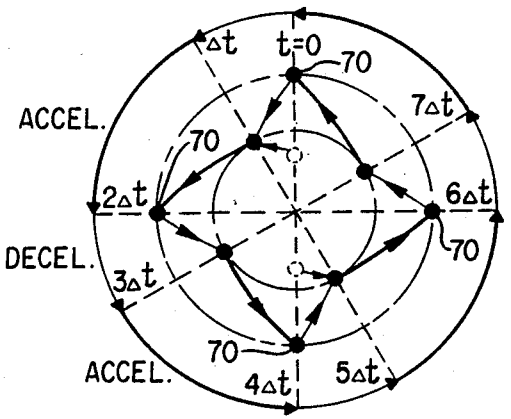

Referring to FIG. 1(*a*), a preferred embodiment of a turbulent stirring unit according to the present invention, generally designated by numeral 10, includes a control unit 20 to be more fully described in connection with FIG. 5(*a*), a platform 30 into which the control unit 20 may be fully or partially integrated, and a stirring element 40 disposed in a beaker 45 and provided with at least one pair of finger-like appendages 50 and 60. These appendages may take any one of a number of forms, two of which are illustrated in FIGS. 3(*a*) and 4(*a*). It will be apparent to one having ordinary skill in the art, however, that other configurations, and including additional arms, may be used. The function of these arms will be more fully explained in connection with FIGS. 3 and 4. As shown in FIG. 2, the stirring element 40 incorporates a permanent magnet to mechanically couple energy from a magnetic field generated within the platform in a manner which will be apparent to one having ordinary skill in the art.

Figure 4A:
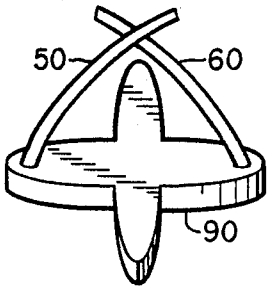
FIG. 4(*a*) is a plan view of a "fling-in" stirring element and FIG. 4(*b*) is a schematic representation of its operation.
Figure 4B:
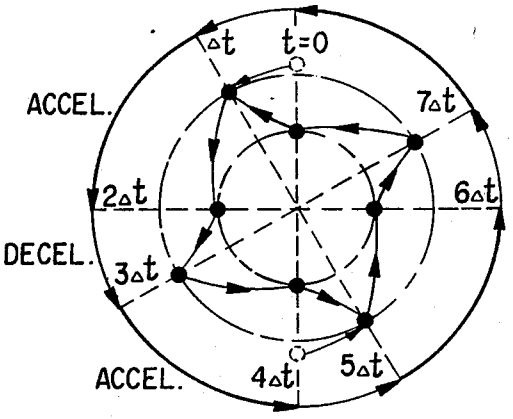

The stirring element 40 of the present invention may be of two basic types, a "fling-out" type (FIGS. 3(*a*) and 3(*b*)) and a "fling-in" type (FIGS. 4(*a*) and 4(*b*)) Both types of stirring elements are provided with at least one pair of finger-like appendages 50,60 composed of a resilient material. In the fling-out type of stirring element 80, the appendages are provided with weights 70 at their ends resulting in an operation represented schematically in FIG. 3(*b*). This figure may be best understood as a series of snapshots taken at equal time intervals overlooking the beaker 45 of FIG. 1(*a*). In both FIGS. 3(*b*) and 4(*b*), a magnetic field is assumed to be rotating counterclockwise and fluctuating alternately between periods of deceleration and periods of acceleration. When the rotation of the magnetic field is decelerated abruptly the stirring element 80,90 travels a shorter angular distance between "snap shots" than when it is being accelerated. Only the positions of the finger weights 70 in FIG. 3(*b*) and the extreme end portions of the fingers in FIG. 4(*b*) have been illustrated.

Referring to FIG. 3(*b*), the stirring element 80 is initially at rest and the appendages 50,60 are in a rest position represented by the dotted-line circles opposed from one another closest to the rotational axis. As the rotating magnetic field begins to accelerate, the resulting centrifugal force acts upon the finger weights 70 forcing the resilient finger elements 50,60 outwardly away from the rotational axis. As the rotation of the magnetic field speeds up, the fingers 50,60 are forced still farther outward. As the rotation of the magnetic field is decelerated, the fingers 50,60 move inward towards the axis of rotation. As the rate of rotation of the magnetic field continues to fluctuate, the fingers 50,60 execute a sweeping undulatory movement that tends to collapse the vortex and results in increased cross-laminar mixing, markedly enhancing the mixing of fluids.

In the fling-in type of stirring element 90 shown in FIGS. 4(*a*) and 4(*b*), the fingers 50,60 are longer and more filamentary, without any weights attached. In the case of the fling-out stirring element 80, the attached finger weights 70 cause outward forces to be much greater than in the case of the fling-in stirring element 90. In the fling in type 90 since the finger weights 70 are absent and the surface area of the elongated fingers 50,60 is increased, the fingers 50,60 tend to incline toward the rotational axis during periods of acceleration and to spring outward during periods of deceleration. In the operation of the present invention the rotational speed fluctuates, causing the fingers 50,60 to execute a sweeping undulatory movement.

Although the stirring elements in FIGS. 2–4 are shown as having X-shaped bases, any suitable shape and configuration may be employed so long as it provides a stable platform for the undulatory movement of the fingers 50,60. Possible alternative shapes include that of a star, a disc, and a ring, the principal constraint being that the stirring element's moment of inertia about the rotational axis be significantly less than its moment of inertia about other axes. The entire stirring element including its fingers may be conveniently composed of a plastic material, most polymer materials being suitable.

Furthermore, although the fingers 50,60 are shown in FIGS. 3 and 4 as being of relatively uniform cross-section, shapes having non-uniform or various different cross-sections may be employed. For instance, instead of being solid, the fingers may be provided with through-holes or vanes. Such perforations and vanes may be employed to provide additional agitation. The fingers 50,60 may also be configured as hydrofoils so as to undulate with variations in rotational speed according to Bernoulli's principle. Further, it should be noted that any combination of the aforementioned types of arms could be employed.

According to another embodiment of the present invention illustrated in FIG. 1(*b*), instead of using a stirring element, the entire vessel containing a fluid composition to be mixed is rotated, causing vortexes to alternately form and collapse. The turbulent stirring unit in this instance is very similar in appearance to that of FIG. 1(*a*), but no stirring element 40 is employed. Instead, a base platform 150 whereon containers and any suitable restraints are placed is rotated according to the fluctuating rate determined by the control unit 20. The liquid-bearing container may be secured by any suitable means, in this instance, a retaining member 155 is affixed to the platform 150 and snugly grips the container.

Figure 5A:
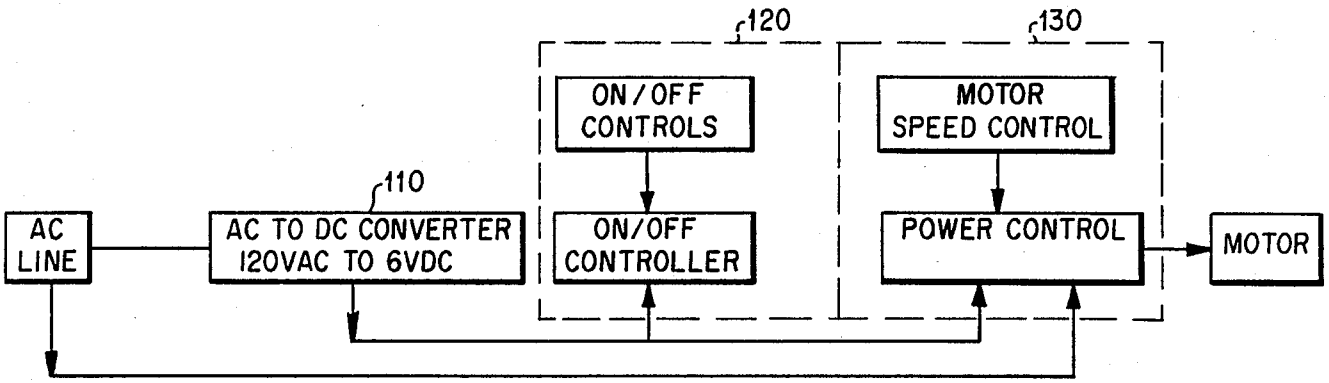
FIG. 5(*a*) is a block diagram of operating components of an electronic implementation of the control unit of FIGS. 1(*a*) and 1(*b*).
Figure 5B:
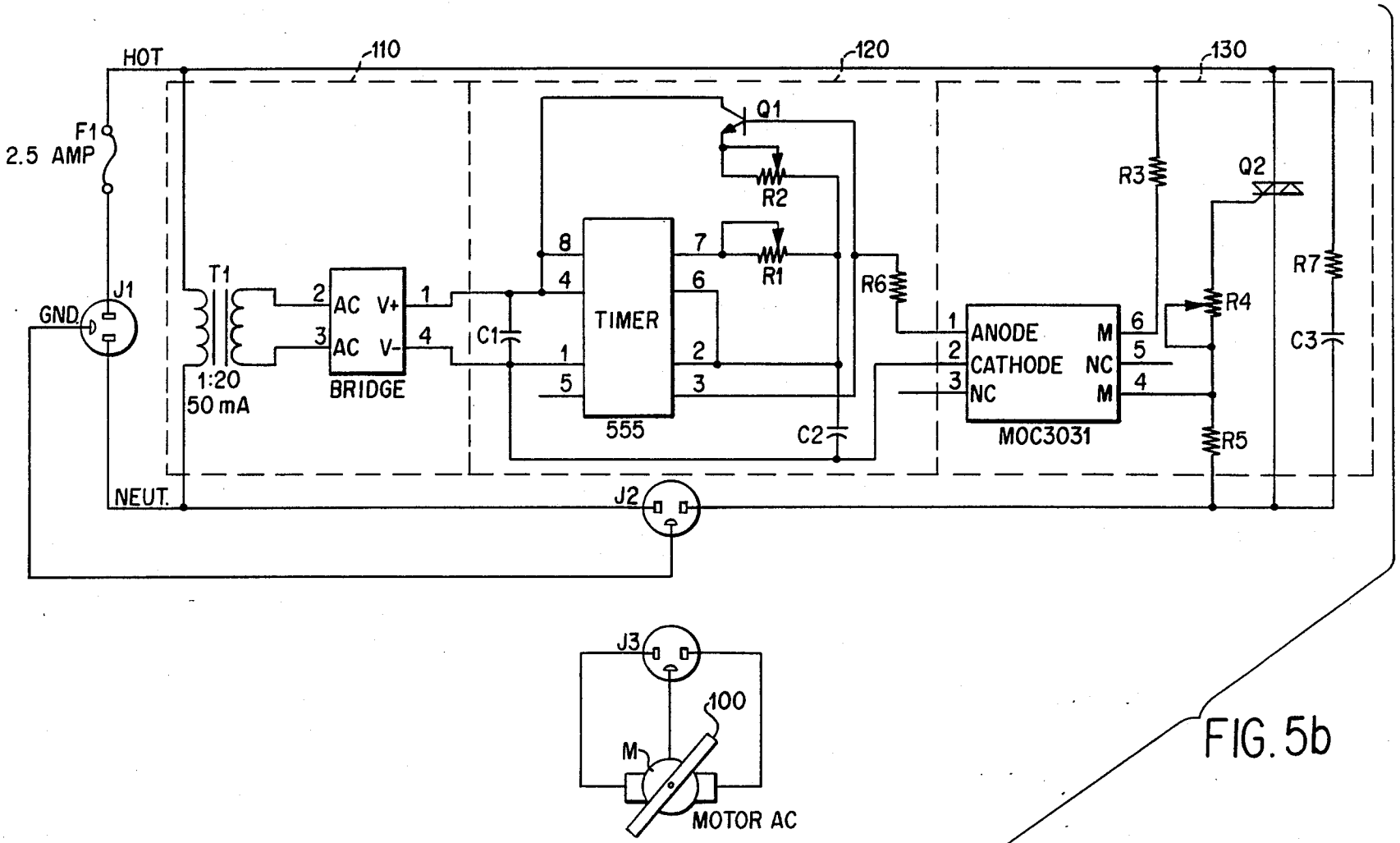

Referring to FIG. 5(*a*), the control unit 20 of FIGS. 1(*a*) and 1(*b*) may be seen as comprising three principal components, an AC to DC conversion unit 110, an ON/OFF time control unit and associated controls 120, and a power control unit and associated controls 130. In one embodiment of this control unit the individual units are, with the exception of discrete resistors, capacitors and transformer, each realized using solid-state integrated circuits. FIG. 5(*b*) illustrates one possible implementation of such a device. It will be apparent to one having ordinary skill in the art that each of the units can be replaced with other means, including electromechanical and mechanical, for performing the same or similar function. For example, the ON/OFF time control unit 120, realized by an IC timer in FIG. 5(*b*), may be replaced with any other means for computing the ON/OFF state of the motor, such as a microprocessor or microcontroller, a sequence generator or a motor speed sensor and cutout circuitry. Similarly, the AC to DC converter 110, realized by a transformer and IC bridge circuit in FIG. 5(*b*), may alternatively be realized in the form of a discrete or component-level solid-state circuit AC to CC converter in a manner well-known in the art.

Figure 6:
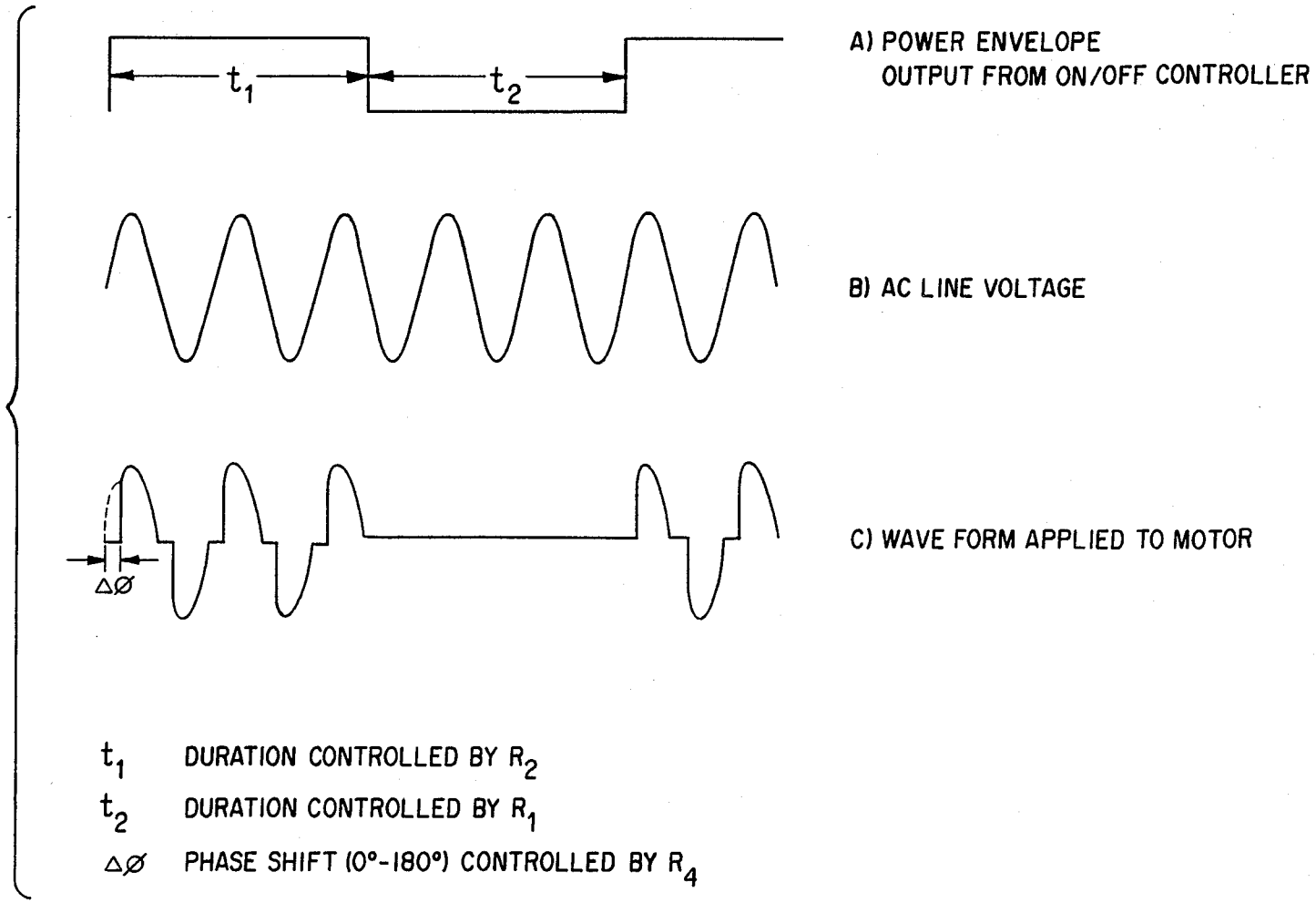
FIG. 6 is a waveform diagram showing the power output of the control unit of FIG. 5(*b*) as it is influenced by certain resistance values.

Optimal mixing will be achieved by the most rapid collapse of the vortex and (in the FIG. 1(*a*) embodiment) flexion/extension of the appendages. One effective approach to this ideal is a square wave pattern of power to abruptly and instantaneously stop and start the rotating magnetic field. In the exemplary embodiment of FIG. 5(*b*), phase-delayed triggering of the thyristor Q2 as controlled by R4 and C4 is combined with square wave duty cycle modulation of the AC line voltage as determined by R1 and R2. The resulting composite waveform as illustrated in FIG. 6 has positive and negative voltage peaks of variable width, depending on the firing phase of the thyristor Q2, interspersed with quiescent periods of zero voltage during which the thyristor Q2 is not fired at al. The ON/OFF switching controlled by R1 and R2 causes the speed of the motor M to accelerate towards a maximum speed determined by R4, the power of the motor and by the drag applied by the stirring element 80, 90 during periods of applied power and to decelerate towards a full stop during periods when no power s supplied, producing the undulating motion of the agitator fingers 50,60 as explained previously in relation to FIGS. 3 and 4.

During acceleration or deceleration the motor receives either the power allotted by R4 or no power at all. However, inertia in the motor and stirring element 80, 90 cause a smoothing of the transitions in speed. Potentiometer R4 controls the width of the positive and negative voltage peaks during conduction periods and hence the average power supplied during those periods. Thus by adjusting the setting of R4, the overall average speed of the motor may be controlled.

Even more advantageously, motor M may be a reversible motor according to a number of constructions well-known in the art. Instead of no power being supplied to the motor during the off half-cycle of the square wave, power would be supplied in opposite phase as before, rapidly braking the movement of the stirring element.

Figure 7A:
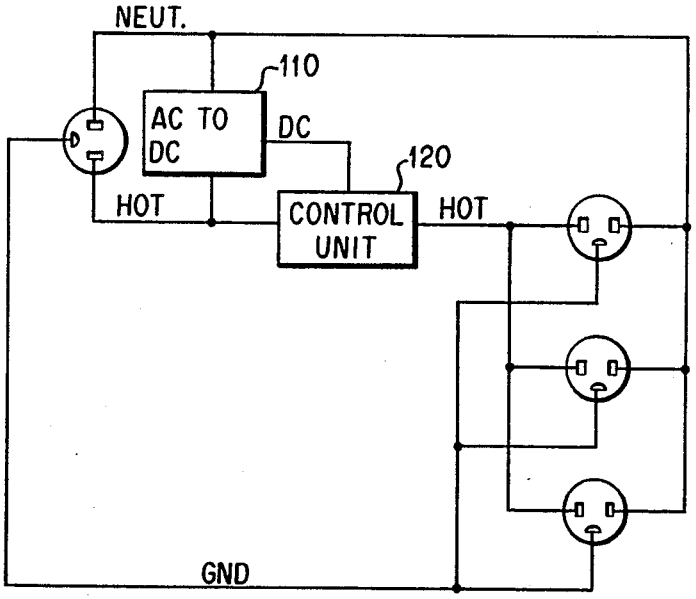
FIGS. 7(*a*) and 7(*b*) are block diagrams of systems for controlling a number of processes according to the method of the present invention.
Figure 7B:
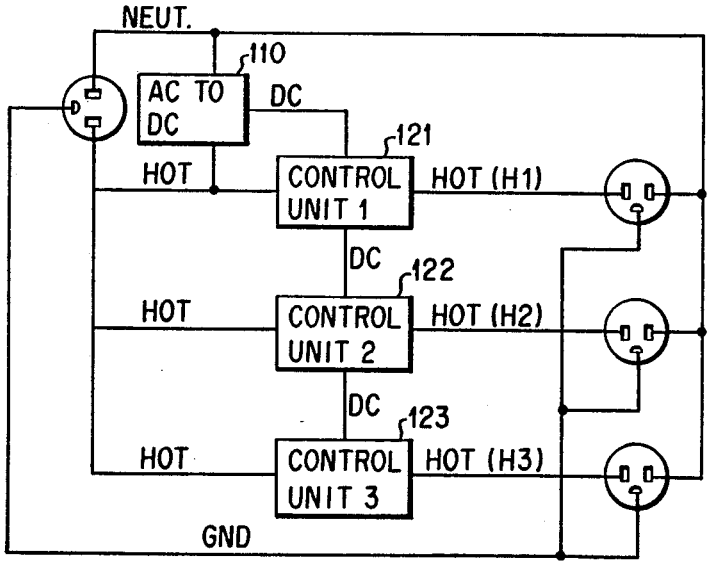

In some instances, it may be desirable to identically control one or more fluid processes or, alternatively, to independently control one or more fluid processes either at the same time or in close succession. Accordingly, the underlying principle of the present invention may be applied to the more general problem of fluid process control wherein a number of hydrokinetic processes may be controlled from a common control panel. In order to allow for such coordinated control, the control unit may have as many independent control sets as required, each with its own speed and ON/OFF controls as shown diagrammatically in FIG. 7(*b*), within the limits of the unit's power ratings. Alternatively, several pieces of equipment may be controlled by one set of controls as indicated in FIG. 7(*a*) so long as the total power requirements are within the ratings of the individual circuit. In FIG. 7(*a*) the control unit 120 represents the component circuitry of the controller of FIG. 5(*a*) with the connection of multiple power circuits for multiple pieces o equipment as indicated. All of the power circuits share a common neutral line, a common ground, and a common "hot" line such that each piece of equipment is identically controlled.

In order to control each piece of equipment independently, the control circuitry of FIG. 5(*a*) may be duplicated for each power circuit (with the exception of the AC to DC conversion unit 110 which need not be duplicated but may be shared in common by all the controllers 121–123) as shown in FIG. 7(*b*). All of the power outlets share a common neutral line and a common ground as in the previous figure. Each circuit is provided with its own hot line, three hot lines H1–H3 being shown in this instance. As previously mentioned, the ON/OFF controller 120 of FIG. 5(*a*) may be replaced with a microprocessor or like means, in which case a single microprocessor could provide independent timing control for numerous pieces of equipment.

Figure 8:
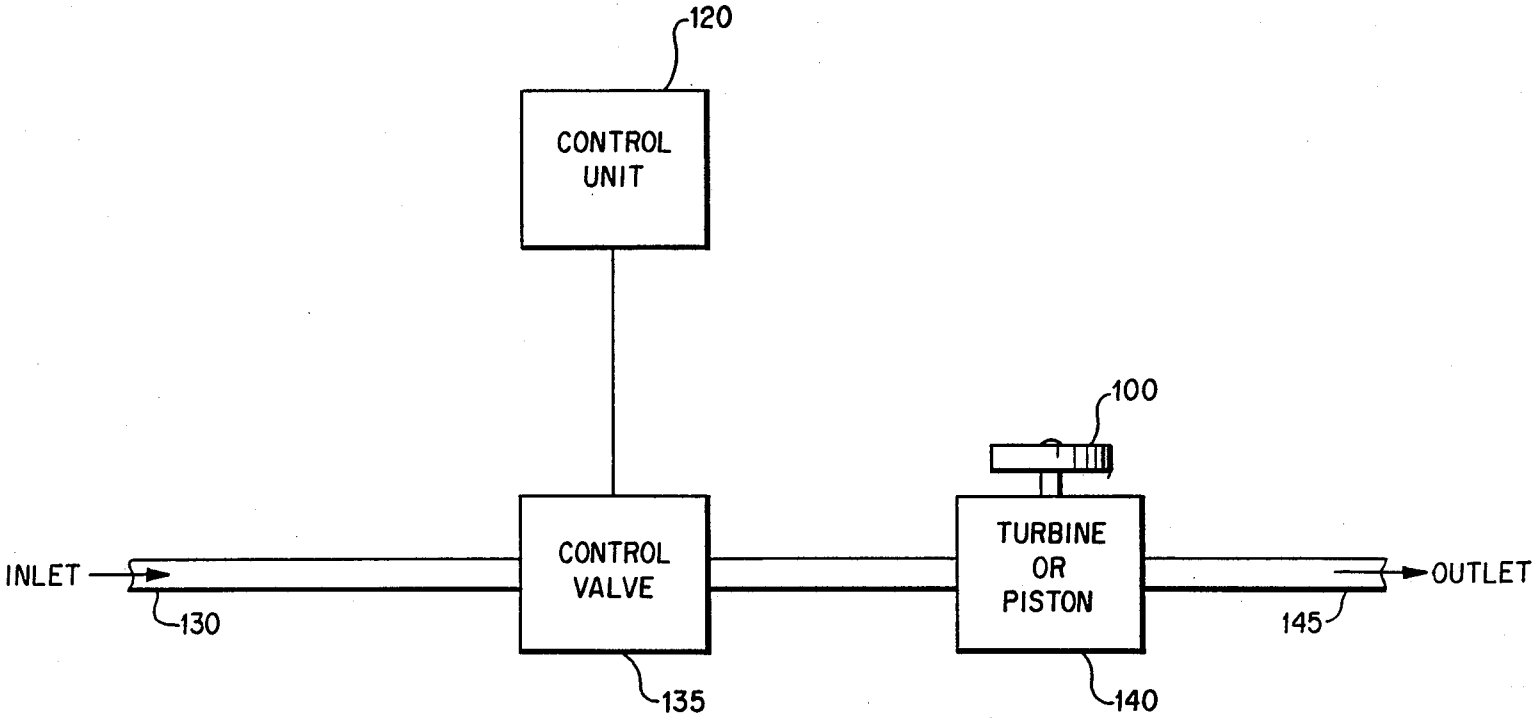
FIG. 8 is a block diagram of a fluid-driven embodiment of the present invention.

The present invention may also use other motive power sources than electric, for instance pneumatic or hydraulic, which are suitable for use in special situations. Such an embodiment is illustrated in FIG. 8. The identical control unit 120 may be used to control, instead of an electric valve, an air or water valve 135 that is electrically actuated. It should be understood that control unit 120 can also be pneumatically or hydralically operated. An inlet 130 and an outlet 145 functions as a "power source" of air or water, and a turbine or piston 140 functions analogously as the previously described electric motor.

Figure 9A:
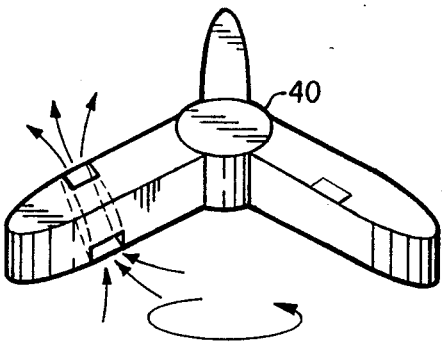
FIGS. 9(*a*)–9(*c*) are perspective views of a stirring element base showing various possible features thereof.
Figure 9B:
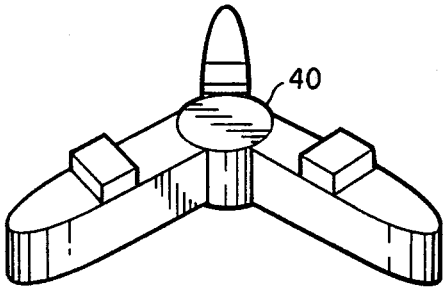
Figure 9C:
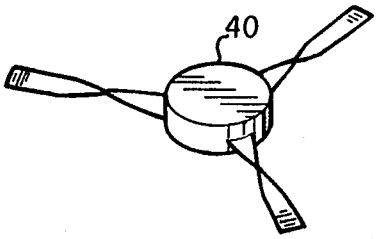

The stirring element of the present invention and particularly the base 40 thereof, is also susceptible to numerous embodiments as illustrated in FIGS. 9(*a*)–9(*c*). Vents may be provided in the base angled at a slant in such a manner as to create liquid spouts as the stirring element rotates as shown in FIG. 9(*a*). The base 40 may also be provided with feet as shown in FIG. 9(*b*) to lift the base off the bottom of the container so as to increase flow through the vents, for instance. The base may also be provided with vanes as illustrated in FIG. 9(*c*). A great number of arrangements that maintain the rotational stability of the base 40 while creating increased turbulence in the surrounding liquid are conceivable and would generally be desirable.

It will be appreciated by those of ordinary skill in the art that the present invention can be embodied in other specific forms without departing from the spirit or essential character thereof. The presently disclosed embodiments are therefore considered in all respects to be illustrative and not restrictive. The scope of the invention is indicated by the appended claims rather than the foregoing description, and all changes which come within the meaning and range of equivalents thereof are intended to be embraced therein.

What is claimed is:

1. A stirring apparatus, comprising:

support means for supporting a container;

means for creating a rotating magnetic field in a volume to be occupied by said container, said magnetic field rotating at a fluctuating rate; and an agitating means having a magnetic dipole for interacting with said rotating magnetic field to cause said agitating means to rotate about a rotational axis at said fluctuating rate, and having a plurality of finger-like appendages for executing a sweeping undulatory movement in a radial direction according to said fluctuating rate.

2. The stirring apparatus of claim 1, wherein said agitating means has a moment of inertia about said rotational axis that is significantly less than its moments of inertia about other axes.

3. The stirring apparatus of claim 2, wherein a base of said agitating means has one of a group of shapes including a cross, star, disk, and ring.

4. The stirring apparatus of claim 2, wherein a base of said agitating means has at least one of the following: elevators, feet, vanes and vents, which act to redirect fluid flow while said agitating device is rotating.

5. The apparatus of claim 2, wherein said appendages are of a resilient composition.

6. The apparatus of claim 5, wherein said appendages emanate from a base of said agitating means and are weighted at an end opposite from a point of emanation, causing said appendages to fling outwardly from said rotational axis as said rotation rate increases.

7. The apparatus of claim 5, wherein said appendages emanate from a base of said agitating means and are so constructed that said appendages fling inwardly toward said rotational axis as said rotation rate increases.

8. The apparatus of claim 5 wherein said appendages are provided with one of perforations and vanes, causing said appendages to incline themselves relative to said rotational axis as said rotation rate increases.

9. The apparatus of claim 1, wherein said means for creating a rotating magnetic field comprise a magnetic dipole rotated by an electric motor supplied with power from a controller circuit.

10. The apparatus of claim 9, wherein speed of said motor is adjustable by pulse width modulation of output power of the controller circuit, said controller circuit having output power ON and output power OFF times adjustable independently from one another.

11. The apparatus of claim 9, wherein said controller circuit comprises an AC to DC conversion circuit, an ON/OFF controller circuit, and a power control circuit, each connected in parallel between a first AC-power lead and a second AC-power lead, said AC to DC conversion circuit being connected to said ON/-OFF controller circuit and said ON/OFF controller circuit being connected to said power control circuit.

12. The apparatus of claim 11, wherein said ON/OFF controller circuit comprises a 555-style timer, a thyristor-driver, and associated discrete resistors, capacitors and transistors and wherein said AC to DC conversion circuit comprises a transformer, a rectifier bridge integrated circuit, and a smoothing capacitor and wherein said power control circuit is a triac device.

13. The apparatus of claim 11, wherein said ON/OFF controller comprises a 555-style timer, a thyristor-driver, and associated discrete resistors and capacitors, said AC to DC conversion circuit comprises a solid state voltage chopper circuit and a smoothing capacitor, and wherein said power control circuit is a triac device.

14. The apparatus of claim 1, wherein said means for creating a rotating magnetic field comprises a magnetic dipole rotated by fluid pressure.

15. The apparatus of claim 14, wherein said ON/OFF controller comprises a 555-style timer, a thyristor-driver, and an AC to DC conversion circuit and, wherein said power control circuit is a solid state device used to control fluid valves.

16. The stirring apparatus of claim 1 wherein said means for creating a rotating magnetic field is further for reversing a direction of rotation of said rotating magnetic field.

17. The stirring apparatus of claim 1 wherein said means for creating a rotating magnetic field comprises power supply means for rotating said magnetic field and means for alternately and instantaneously switching said power supply means off and on.

* * * * *